US009655418B2

(12) United States Patent
Chien et al.

(10) Patent No.: US 9,655,418 B2
(45) Date of Patent: May 23, 2017

(54) SUITCASE WITH REMOVABLE WALKING-STICK EXTENSIBLE ROD

(71) Applicants: Li-Sheng Chien, Taipei (TW); Chien-Chang Ho, Taipei (TW)

(72) Inventors: Li-Sheng Chien, Taipei (TW); Chien-Chang Ho, Taipei (TW)

( * ) Notice: Subject to any disclaimer, the term of this patent is extended or adjusted under 35 U.S.C. 154(b) by 83 days.

(21) Appl. No.: 14/842,258

(22) Filed: Sep. 1, 2015

(65) Prior Publication Data

US 2017/0055657 A1 Mar. 2, 2017

(51) Int. Cl.

| | |
|---|---|
| ***A45C 13/26*** | (2006.01) |
| ***A45C 9/00*** | (2006.01) |
| ***A45C 5/03*** | (2006.01) |
| ***A45B 1/00*** | (2006.01) |

(52) U.S. Cl.

CPC ..... *A45C 9/00* (2013.01); *A45B 1/00* (2013.01); *A45C 5/03* (2013.01); *A45C 2009/007* (2013.01)

(58) Field of Classification Search

CPC ..... A45C 13/22; A45C 13/26; A45B 1/00
USPC ..... 190/1, 39, 102, 115; 135/66, 69; 248/535, 540
See application file for complete search history.

(56) References Cited

U.S. PATENT DOCUMENTS 3,257,120 A * 6/1966 Browning ..... A45C 5/14 190/18 A
4,066,156 A * 1/1978 Basile ..... A45C 11/00 190/18 A
4,550,813 A * 11/1985 Browning ..... A45C 5/00 190/102
5,873,550 A * 2/1999 Phillips ..... F16L 3/1075 248/73
6,199,819 B1 * 3/2001 Churillo ..... A45B 11/00 135/16
6,595,226 B2 * 7/2003 Uemura ..... A45B 9/00 135/69
7,021,324 B1 * 4/2006 Clay ..... A61H 3/04 135/66
7,163,020 B2 * 1/2007 Miyoshi ..... A45B 1/02 135/67
7,422,188 B1 * 9/2008 Schlosser ..... A45B 1/04 224/407
8,439,057 B2 * 5/2013 Parry ..... A45B 9/00 135/66
2005/0057021 A1 * 3/2005 Miyoshi ..... A61G 5/00 280/657
2005/0067245 A1 * 3/2005 Tsai ..... A45C 13/262 190/115
2011/0240076 A1 * 10/2011 Hateley ..... A61H 3/0244 135/66

* cited by examiner

*Primary Examiner* — Sue A Weaver
(74) *Attorney, Agent, or Firm* — WPAT, P.C., Intellectual Property Attorneys; Anthony King; Kay Yang

(57) ABSTRACT

A suitcase with a removable walking-stick extensible rod includes a suitcase body having a receiving chamber and a mouth, with the mouth disposed at the top of the suitcase body to communicate with the receiving chamber; a fastening and releasing element fixedly disposed in the receiving chamber; and a walking-stick extensible rod having an extensible rod body and a handle, with the extensible rod body received in the receiving chamber and disposed at the fastening and releasing element, and the handle connected to an end of the extensible rod body and disposed at the mouth.

9 Claims, 6 Drawing Sheets

SUITCASE WITH REMOVABLE WALKING-STICK EXTENSIBLE ROD

FIELD OF THE INVENTION

The present invention relates to suitcases and, more particularly, to a suitcase with a removable walking-stick extensible rod which can operate independently when removed from the suitcase.

BACKGROUND OF THE INVENTION

Recent years see a surge in tourism worldwide. The demand for suitcases increases with tourists.

Although suitcases are good enough for most tourists, those tourists who are of advanced age, disabled or fascinated with hiking need both a suitcase and a stick. It is inconvenient for such tourists to carry sticks while traveling with suitcases. Sticks may be readily put inside suitcases, albeit at the expense of internal space of the suitcases.

Accordingly, it is imperative to provide a way of coupling a stick and a suitcase together.

SUMMARY OF THE INVENTION

In view of the aforesaid drawbacks of the prior art, it is an objective of the present invention to provide a suitcase with a removable walking-stick extensible rod which can operate independently when removed from the suitcase.

In order to achieve the above and other objectives, the present invention provides a suitcase with a removable walking-stick extensible rod. The suitcase with a removable walking-stick extensible rod comprises: a suitcase body having a receiving chamber and a mouth, with the mouth disposed at a top of the suitcase body to communicate with the receiving chamber; a fastening and releasing element fixedly disposed in the receiving chamber; and a walking-stick extensible rod having an extensible rod body and a handle, with the extensible rod body received in the receiving chamber and disposed at the fastening and releasing element, and with the handle connected to an end of the extensible rod body and disposed at the mouth.

In an embodiment of the present invention, the suitcase body has a first engaging portion disposed at a bottom of the receiving chamber, and a second engaging portion corresponding in position to the first engaging portion is disposed on a lateral side of the extensible rod body.

In an embodiment of the present invention, the suitcase body has a recess positioned proximate to a bottom of the suitcase body, and another end of the extensible rod body is disposed at the recess.

In an embodiment of the present invention, a bottom of the receiving chamber tilts toward an inside of the suitcase body.

In an embodiment of the present invention, the fastening and releasing element has a clamper and a fastener. The clamper comprises: a clamper body fixed to a bottom of the receiving chamber, wherein a top plate of the clamper body has a through hole; a withdrawal spring received in the clamper body and abutting against a bottom plate of the clamper body; a withdrawal element fitted to the withdrawal spring to penetrate the through hole; a right clamping element slidably disposed on the right side of the clamper body and abutting against a right sidewall of the clamper body through a right spring; a left clamping element slidably disposed on the left side of the clamper body and abutting against a left sidewall of the clamper body through a left spring, wherein the extensible rod body is clamped between the right clamping element and the left clamping element, and the fastener is engaged with the right clamping element and the left clamping element; a right button having a right pushing end and a right pressing end, with the right pushing end being adjacent to the left clamping element, and the right pressing end disposed on the right side of the clamper body; and a left button having a left pushing end and a left pressing end, with the left pushing end being adjacent to the right clamping element, and the left pressing end disposed on the left side of the clamper body.

In an embodiment of the present invention, the clamper further comprises: a right rubber pad disposed on an inner side of the right clamping element; and a left rubber pad disposed on an inner side of the left clamping element, wherein the extensible rod body is clamped between the right rubber pad and the left rubber pad.

In an embodiment of the present invention, the fastener comprises: a pivotal connection portion disposed beside the fastener and pivotally connected to one of the right clamping element and the left clamping element; and a snap-engagement portion disposed on another side of the fastener and movably snap-engaged with a bump disposed on the other one of the right clamping element and the left clamping element.

In an embodiment of the present invention, the fastener further comprises an upper rubber pad disposed at a bottom of the fastener.

In an embodiment of the present invention, the extensible rod body comprises a plurality of sleeve pipes movably fitted to each other, wherein the handle is connected to the sleeve pipes above.

In an embodiment of the present invention, the extensible rod body has a lever and at least a resilient snap-engagement body. The lever is movably disposed at the sleeve pipes above, wherein the sleeve pipes each have at least a snap-engagement hole. The lever is linked to the resilient snap-engagement body, such that the resilient snap-engagement body is movably snap-engaged with the snap-engagement holes to thereby extend and retract the extensible rod body.

Therefore, the present invention provides a suitcase with a removable walking-stick extensible rod, characterized in that: given a receiving chamber of the suitcase body, the walking-stick extensible rod and the fastening and releasing element, the walking-stick extensible rod can be coupled to the suitcase to function as the handle of the suitcase or separated from the suitcase to function as a stick; furthermore, the surface of the bottom of the receiving chamber tilts in manner to allow the user to press on the handle of the walking-stick extensible rod in order to take a rest.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
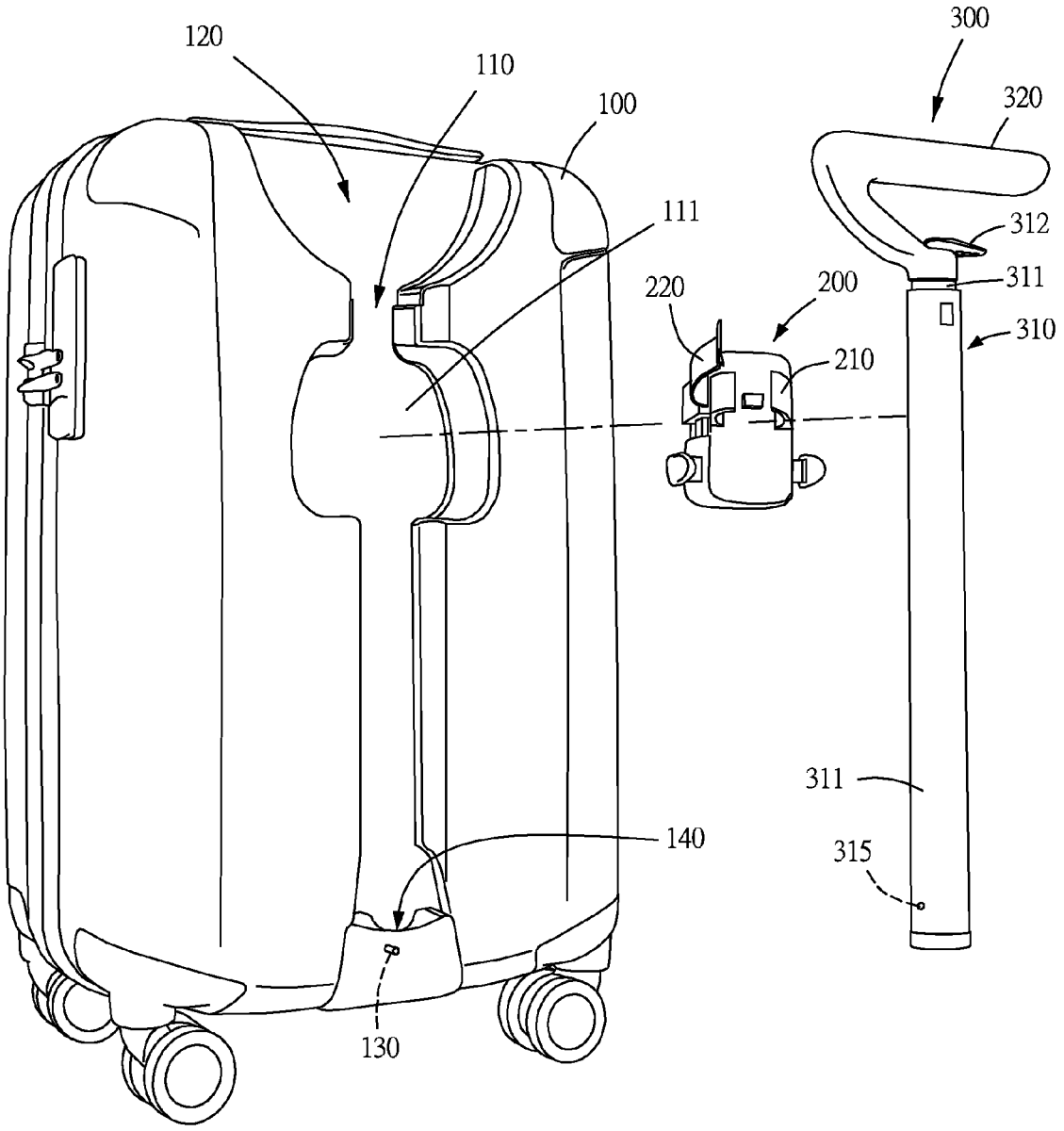
FIG. 1 is an exploded view of a suitcase with a removable walking-stick extensible rod according to an embodiment of the present invention.
Figure 2:
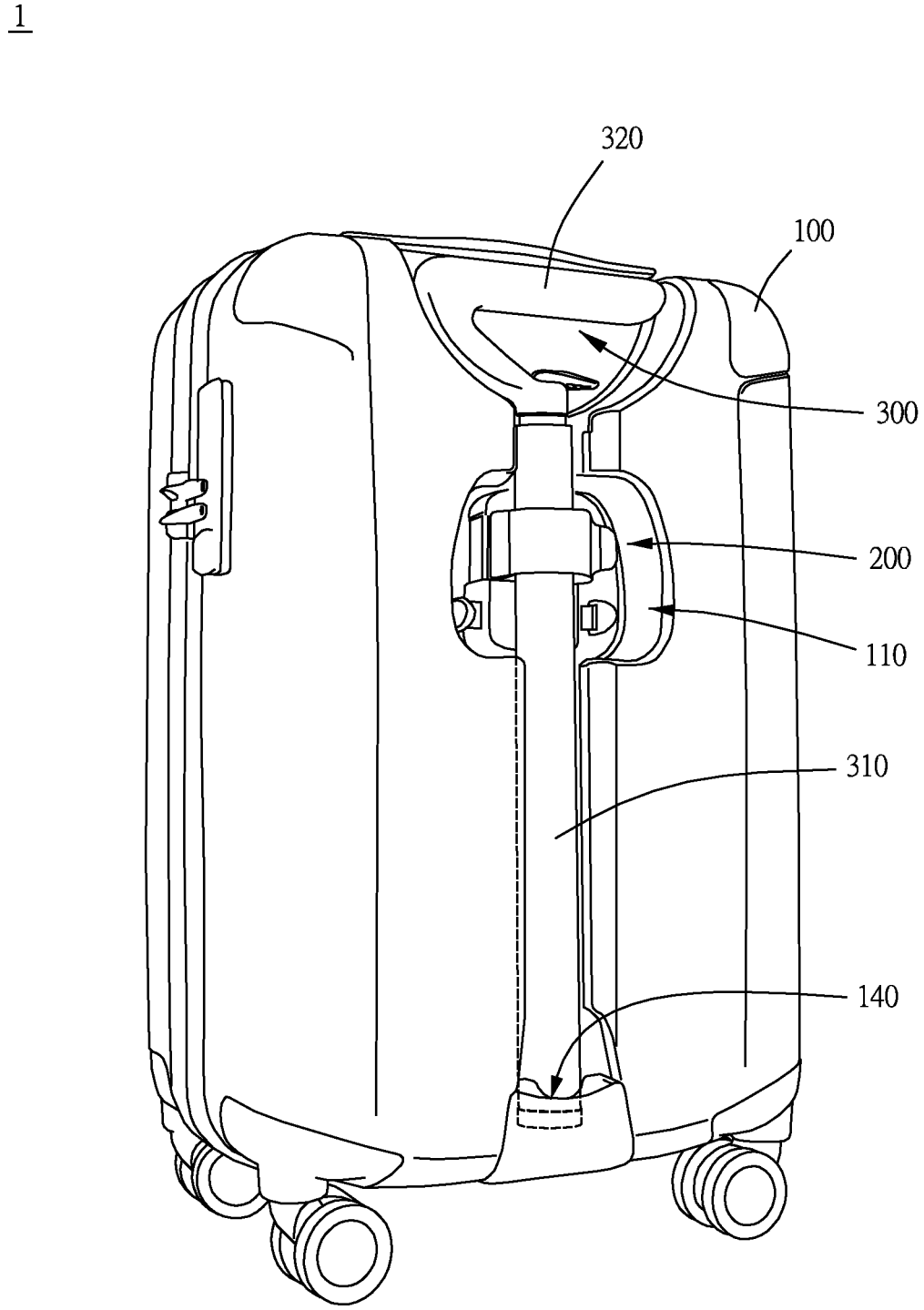
FIG. 2 is a perspective view of the suitcase with a removable walking-stick extensible rod according to an embodiment of the present invention.
Figure 3:
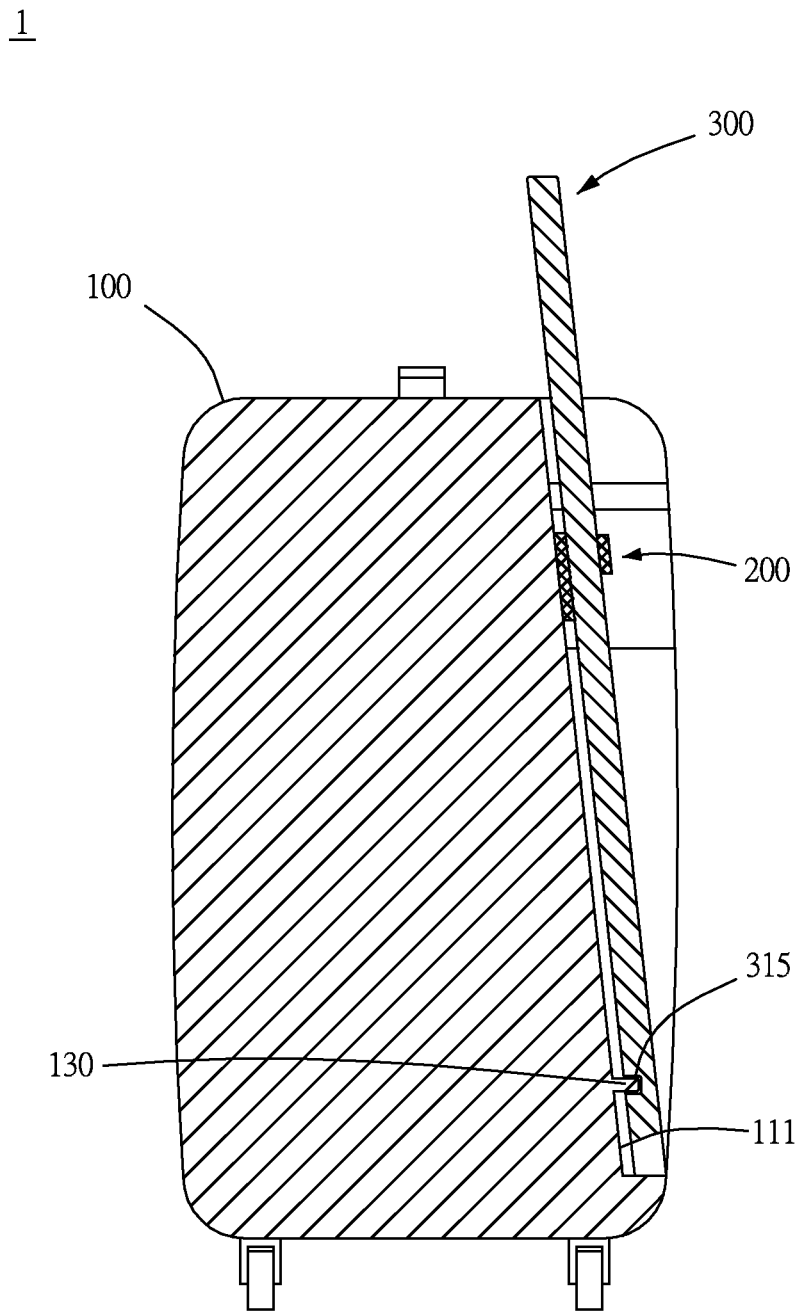
FIG. 3 is a cross-sectional view of the suitcase with a removable walking-stick extensible rod according to an embodiment of the present invention.

Referring to FIG. 1, FIG. 2 and FIG. 3, the prevent invention provides a suitcase 1 with a removable walking-stick extensible rod according to an embodiment of the present invention. FIG. 1 is an exploded view of the suitcase 1 with a removable walking-stick extensible rod according to an embodiment of the present invention. FIG. 2 is a perspective view of the suitcase 1 with a removable walking-stick extensible rod according to an embodiment of the present invention. FIG. 3 is a cross-sectional view of the suitcase 1 with a removable walking-stick extensible rod according to an embodiment of the present invention.

The suitcase 1 with a removable walking-stick extensible rod comprises a suitcase body 100, a fastening and releasing element 200, and a walking-stick extensible rod 300.

The suitcase body 100 has a receiving chamber 110 and a mouth 120. The receiving chamber 110 is concavely disposed on a casing of the suitcase body 100. The mouth 120 is disposed at the top of the suitcase body 100 so as to be in communication with the receiving chamber 110. Furthermore, the suitcase body 100 has a recess 140. The recess 140 is positioned proximate to the bottom of the suitcase body 100. In this embodiment, a bottom 111 of the receiving chamber 110 tilts toward the inside of the suitcase body 100, and the angle of inclination of the bottom 111 relative to a perpendicular line equals 10~15, but the present invention is not limited thereto.

The fastening and releasing element 200 is fixedly disposed in the receiving chamber 110 when fastened or adhered thereto, but the present invention is not limited thereto.

The walking-stick extensible rod 300 has an extensible rod body 310 and a handle 320. The extensible rod body 310 is removably received in the receiving chamber 110 and disposed at the fastening and releasing element 200, whereas the handle 320 is connected to an end of the extensible rod body 310 and disposed at the mouth 120. When the extensible rod body 310 is received in the receiving chamber 110, another end of the extensible rod body 310 can be movably inserted into the recess 140 of the suitcase body 100. Furthermore, the extensible rod body 310 of the walking-stick extensible rod 300 comprises a plurality of sleeve pipes 311 movably fitted to each other, and thus the extensible rod body 310 of the walking-stick extensible rod 300 is extensible.

Furthermore, the extensible rod body 310 of the walking-stick extensible rod 300 and the receiving chamber 110 of the suitcase body 100 are temporarily engaged with each other by a corresponding engagement structure. For example, the suitcase body 100 has a first engaging portion 130 (such as a post). The first engaging portion 130 is disposed at the bottom 111 of the receiving chamber 110. Preferably, the first engaging portion 130 is disposed at the recess 140. A second engaging portion 315 (such as a dent) corresponding in position to the first engaging portion 130 is disposed on the lateral side of the extensible rod body 310. However, the corresponding engagement structure is not limited thereto, as it can be whatever structure whereby the extensible rod body 310 of the walking-stick extensible rod 300 and the receiving chamber 110 of the suitcase body 100 can be temporarily engaged with each other without going beyond the scope of the disclosure described herein.

Due to the above components, structures and configuration, the walking-stick extensible rod 300 can be fixedly disposed in the receiving chamber 110 of the suitcase body 100 by means of the fastening and releasing element 200. Due to the corresponding engagement structure (that is, the first engaging portion 130 and the second engaging portion 315) disposed between the extensible rod body 310 and the receiving chamber 110, the walking-stick extensible rod 300 and the suitcase body 100 can be coupled together. To separate the walking-stick extensible rod 300 from the suitcase body 100, it is feasible to open the fastener 220 and clamper 210 of the fastening and releasing element 200 and take the walking-stick extensible rod 300 out of the suitcase body 100.

Figure 4:
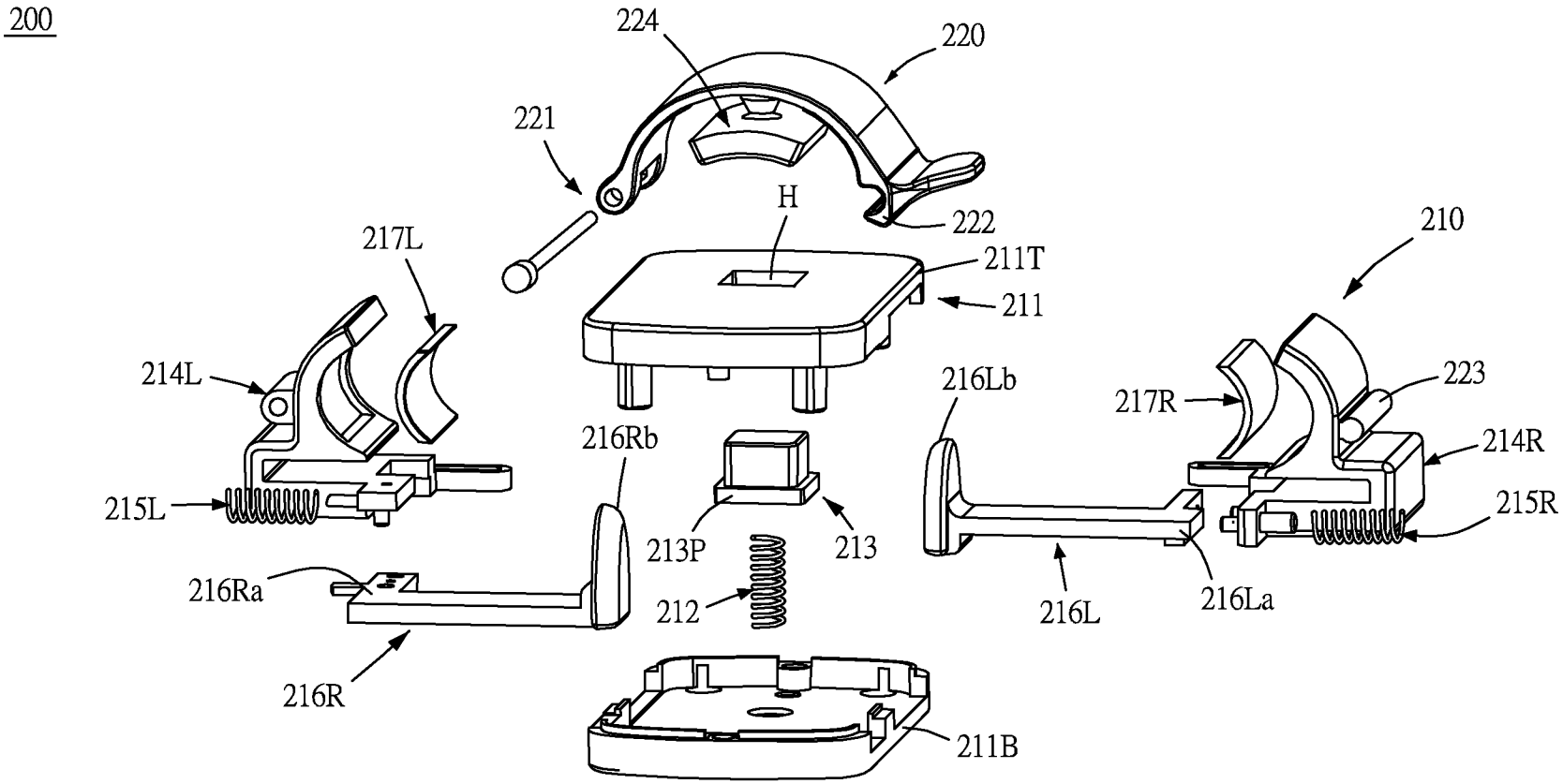
FIG. 4 is an exploded view of a fastening and releasing element of the suitcase with a removable walking-stick extensible rod according to an embodiment of the present invention.
Figure 5:
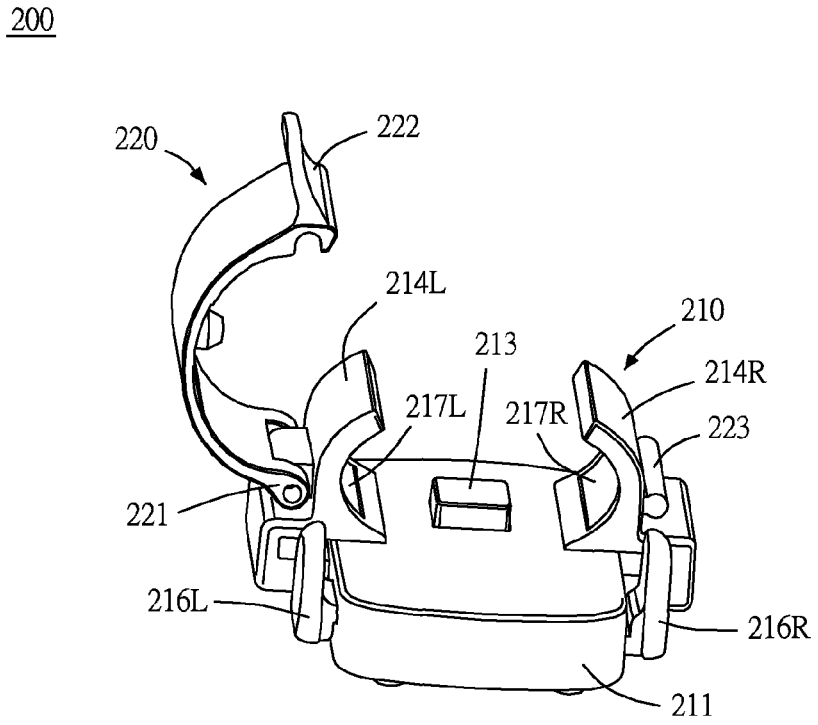
FIG. 5 is a schematic view of the suitcase with a removable walking-stick extensible rod, showing that a clamper and a fastener of the fastening and releasing element are in a released state according to an embodiment of the present invention.
Figure 6:
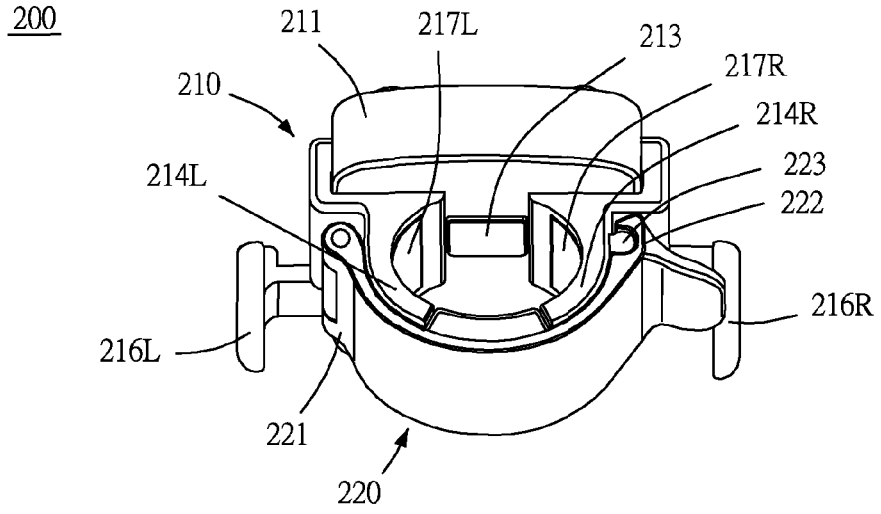
FIG. 6 is a schematic view of the suitcase with a removable walking-stick extensible rod, showing that the clamper and the fastener of the fastening and releasing element are in a fastened state according to an embodiment of the present invention.

Referring to FIG. 4, FIG. 5 and FIG. 6, the prevent invention provides the suitcase 1 with a removable walking-stick extensible rod according to another embodiment of the present invention. FIG. 4 is an exploded view of a fastening and releasing element 200 of the suitcase 1 with a removable walking-stick extensible rod according to an embodiment of the present invention. FIG. 5 is a schematic view of the suitcase 1 with a removable walking-stick extensible rod, showing that a clamper 210 and a fastener 220 of the fastening and releasing element 200 are in a released state according to an embodiment of the present invention. FIG. 6 is a schematic view of the suitcase 1 with a removable walking-stick extensible rod, showing that the clamper 210 and the fastener 220 of the fastening and releasing element 200 are in a fastened state according to an embodiment of the present invention.

The clamper 210 comprises a clamper body 211, a withdrawal spring 212, a withdrawal element 213, a right clamping element 214R, a left clamping element 214L, a right spring 215R, a left spring 215L, a right button 216R and a left button 216L.

The clamper body 211 is fixed to the bottom 111 of the receiving chamber 110 when fastened or adhered thereto, but the present invention is not limited thereto. Furthermore, the clamper body 211 comprises a top plate 211T and a bottom plate 211B which are coupled together, wherein the top plate 211T of the clamper body 211 has a through hole H.

The withdrawal spring 212 is received in the clamper body 211 and abuts against the bottom plate 211B of the clamper body 211. The withdrawal spring 212 penetrates the through hole H of the top plate 211T.

The withdrawal element 213 is fitted to the withdrawal spring 212. Therefore, the withdrawal element 213 penetrates the through hole H so as to undergo a reciprocating motion because of the resilience of the withdrawal spring 212. Furthermore, the withdrawal element 213 is annularly provided with a protruding structure 213P, and the protruding structure 213P has larger dimensions than the through hole H; hence, the protruding structure 213P of the withdrawal element 213 is engaged with the through hole H to prevent the withdrawal element 213 from separating from the clamper body 211, whenever the withdrawal spring 212 abuts against the withdrawal element 213.

The right clamping element 214R is slidably disposed on the right side of the clamper body 211. The right clamping element 214R has a dent structure. The dent structure is movably engaged with the right portion of the top plate 211T of the clamper body 211, such that the right clamping element 214R can slide freely on the right side of the clamper body 211. Furthermore, the right clamping element 214R abuts against the right sidewall of the clamper body 211 because of the right spring 215R disposed in the right clamping element 214R and thus tends to move toward the center of the clamper body 211.

The left clamping element 214L is slidably disposed on the left side of the clamper body 211. The left clamping element 214L has a dent structure. The dent structure is movably engaged with the left portion of the top plate 211T of the clamper body 211, such that the left clamping element 214L can slide freely on the left side of the clamper body 211. Furthermore, the left clamping element 214L abuts against the left sidewall of the clamper body 211 because of the left spring 215L disposed in the left clamping element 214L and thus tends to move toward the center of the clamper body 211.

Hence, the right clamping element 214R and the left clamping element 214L tend to move toward each other because of the right spring 215R and the left spring 215L. Therefore, the extensible rod body 310 can be clamped between the right clamping element 214R and the left clamping element 214L.

The right button 216R has a right pushing end 216Ra and a right pressing end 216Rb. The right pushing end 216Ra is adjacent to the left clamping element 214L. The right pressing end 216Rb is disposed on the right side of the clamper body 211. As soon as a force is applied from the clamper body 211 to press on the right pressing end 216Rb, the right pushing end 216Ra moves leftward to thereby push the left clamping element 214L, such that the left clamping element 214L moves away from the center of the clamper body 211.

The left button 216L has a left pushing end 216La and a left pressing end 216Lb. The left pushing end 216La is adjacent to the right clamping element 214R. The left pressing end 216Lb is disposed on the left side of the clamper body 211. As soon as a force is applied from the clamper body 211 to press on the left pressing end 216Lb, the left pushing end 216La moves rightward to thereby push the right clamping element 214R, such that the right clamping element 214R moves away from the center of the clamper body 211.

When pressing on the right button 216R and the left button 216L simultaneously, the right clamping element 214R and the left clamping element 214L move together away from the center of the clamper body 211 in a manner known as the released state of the clamper 210. Conversely, in the absence of any force exerted upon the right button 216R and the left button 216L, the right clamping element 214R and the left clamping element 214L move together toward the center of the clamper body 211 in a manner known as the fastened state of the clamper 210.

Furthermore, the clamper 210 further comprises a right rubber pad 217R and a left rubber pad 217L. The right rubber pad 217R is disposed on the inner side of the right clamping element 214R, whereas the left rubber pad 217L is disposed on the inner side of the left clamping element 214L to therefore increase the friction between the clamper 210 and the extensible rod body 310 of the walking-stick extensible rod 300, such that the extensible rod body 310 of the walking-stick extensible rod 300 can be clamped in the clamper 210 without any chance of sliding.

The fastener 220 comprises a pivotal connection portion 221 and a snap-engagement portion 222.

The pivotal connection portion 221 is disposed beside the fastener 220. The pivotal connection portion 221 is pivotally connected to one of the right clamping element 214R and the left clamping element 214L by a shaft. The snap-engagement portion 222 is disposed on the other side and thus opposite to the pivotal connection portion 221. The snap-engagement portion 222 is movably snap-engaged with a bump 223. The bump 223 is disposed on the other one of the right clamping element 214R and the left clamping element 214L. In this embodiment, the pivotal connection portion 221 is pivotally connected to the left clamping element 214L, whereas the bump 223 is disposed at the right clamping element 214R, such that the snap-engagement portion 222 of the fastener 220 can be snap-engaged with the bump 223 disposed on the right clamping element 214R.

The situation where the snap-engagement portion 222 of the fastener 220 is not snap-engaged with the bump 223 disposed on the right clamping element 214R is known as the released state of the fastener 220. Conversely, the situation where the snap-engagement portion 222 of the fastener 220 is snap-engaged with the bump 223 disposed on the right clamping element 214R (that is, the fastener 220 is engaged with the right clamping element 214R and the left clamping element 214L) is known as the fastened state of the fastener 220.

Furthermore, the fastener 220 further comprises an upper rubber pad 224. The upper rubber pad 224 is disposed at the bottom of the fastener 220 to therefore increase the friction between the fastener 220 and the extensible rod body 310 of the walking-stick extensible rod 300, such that the extensible rod body 310 of the walking-stick extensible rod 300 can be fixed to the fastener 220 without any chance of sliding.

Figure 7:
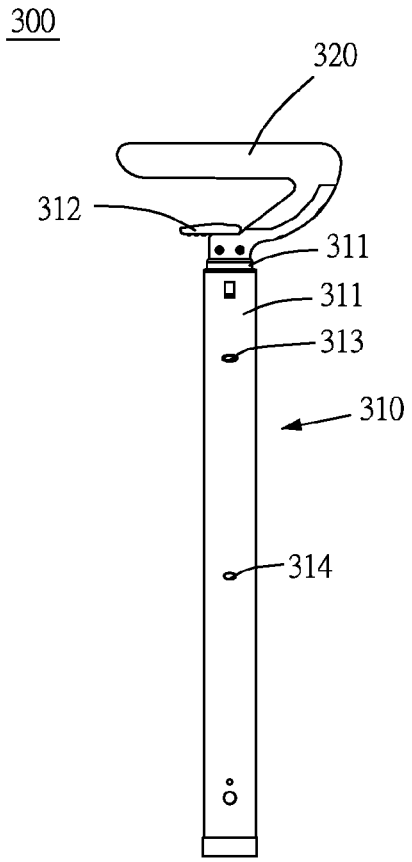
FIG. 7 is a schematic view of the suitcase with a removable walking-stick extensible rod, showing that a walking-stick extensible rod is in a retracted state according to an embodiment of the present invention.
Figure 8:
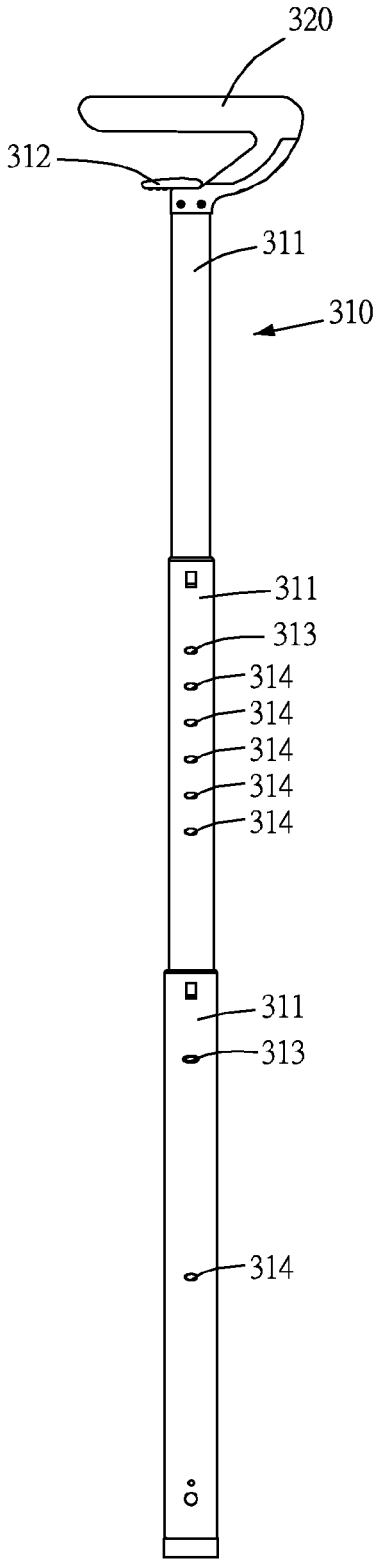
FIG. 8 is a schematic view of the suitcase with a removable walking-stick extensible rod, showing that the walking-stick extensible rod is in an extended state according to an embodiment of the present invention.

Referring to FIG. 7 and FIG. 8, the prevent invention provides the suitcase 1 with a removable walking-stick extensible rod according to yet another embodiment of the present invention. FIG. 7 is a schematic view of the suitcase 1 with a removable walking-stick extensible rod 300, showing that a walking-stick extensible rod is in a retracted state according to an embodiment of the present invention. FIG. 8 is a schematic view of the suitcase 1 with a removable walking-stick extensible rod, showing that the walking-stick extensible rod 300 is in an extended state according to an embodiment of the present invention.

The extensible rod body 310 of the walking-stick extensible rod 300 has a lever 312 and at least a resilient snap-engagement body 313. The lever 312 is movably disposed at the sleeve pipes 311 above. The sleeve pipes 311 each have at least a snap-engagement hole 314. The lever 312 is linked to the resilient snap-engagement body 313 through a link bar (not shown). Therefore, due to the lever 312, it is feasible to control the resilient snap-engagement body 313 in being movably snap-engaged with the snap-engagement holes 314 so as to extend and retract the extensible rod body 310.

Furthermore, in this embodiment, the number of the resilient snap-engagement bodies 313 is two or more so as to be snap-engaged with the snap-engagement holes 314 in accordance with the resilient snap-engagement body 313 located at different positions vertically, such that the extensible rod body 310 has different extended lengths. Hence, there is a wide range of variations in the extended lengths of the extensible rod body 310 so that the extensible rod body 310 suitable any human being of any height.

The connection and separation of the walking-stick extensible rod 300 and the suitcase body 100 is described below.

First, the second engaging portion 315 of the extensible rod body 310 of the walking-stick extensible rod 300 is aligned with the first engaging portion 130 of the suitcase body 100. Then, the extensible rod body 310 is received in the receiving chamber 110, and the other end of the extensible rod body 310 is disposed at the recess 140 of the suitcase body 100. Hence, the second engaging portion 315 of the extensible rod body 310 can be engaged with the first engaging portion 130 of the suitcase body 100. Afterward, the fastener 220 of the fastening and releasing element 200 is opened, and a force is applied to the clamper 210 of the fastening and releasing element 200 until the clamper 210 and fastener 220 enter the released state, such that the extensible rod body 310 is temporarily engaged with the clamper 210. Then, as soon as the extensible rod body 310 is temporarily engaged with the clamper 210, the force is stopped, such that the clamper 210 is restored to the fastened state. Finally, the snap-engagement portion 222 of the fastener 220 is snap-engaged with the bump 223 of the right clamping element 214R again, so as to finalize the connection of the walking-stick extensible rod 300 and the suitcase body 100. By contrast, to separate the walking-stick extensible rod 300 from the suitcase body 100, the above process flow is carried out reversely.

During the operation, when the extensible rod body 310 of the walking-stick extensible rod 300 is received in the receiving chamber 110, the bottom 111 of the receiving chamber 110 tilts toward the inside of the suitcase body 100. When the extensible rod body 310 of the walking-stick extensible rod 300 is in the extended state, the handle 320 is centrally located above the suitcase body 100. When a user's hand presses on the handle 320, the press is always directed at the center of the suitcase body 100. Hence, the suitcase 1 with a removable walking-stick extensible rod is unlikely to tilt, even though the user's hand presses on the handle 320 of the walking-stick extensible rod 300. Therefore, the user can take the liberty of pressing his or her hand on the handle 320 of the walking-stick extensible rod 300 to take a good rest.

Furthermore, when the user is dragging the suitcase 1 with a removable walking-stick extensible rod, the walking-stick extensible rod 300 is coupled to the suitcase body 100 because of the fastening and releasing element 200 and the corresponding engagement structure (that is, the first engaging portion 130 and the second engaging portion 315); hence, the walking-stick extensible rod 300 is unlikely to be disconnected from the suitcase body 100.

Therefore, tourists in need of a stick find the suitcase 1 of the present invention useful and convenient, as the walking-stick extensible rod 300 can be coupled to the suitcase body 100 or separated from the suitcase body 100 as needed. For example, to carry the suitcase 1, a user can have the walking-stick extensible rod 300 coupled to the suitcase body 100 so as to drag the suitcase body 100. To access the stick, the user separates the walking-stick extensible rod 300 from the suitcase body 100, such that the walking-stick extensible rod 30 functions as a stick.

In conclusion, the present invention provides a suitcase with a removable walking-stick extensible rod, characterized in that: given a receiving chamber of the suitcase body, the walking-stick extensible rod and the fastening and releasing element, the walking-stick extensible rod can be coupled to the suitcase to function as the handle of the suitcase or separated from the suitcase to function as a stick; furthermore, the surface of the bottom of the receiving chamber tilts in manner to allow the user to press on the handle of the walking-stick extensible rod in order to take a rest.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A suitcase with a removable walking-stick extensible rod, comprising:

a suitcase body having a receiving chamber and a mouth, with the mouth disposed at a top of the suitcase body to communicate with the receiving chamber;

a fastening and releasing element fixedly disposed in the receiving chamber; and a walking-stick extensible rod having an extensible rod body and a handle, with the extensible rod body received in the receiving chamber and disposed at the fastening and releasing element, and with the handle connected to an end of the extensible rod body and disposed at the mouth;

wherein a bottom of the receiving chamber tilts toward an inside of the suitcase body.

2. The suitcase of claim 1, wherein the suitcase body has a first engaging portion disposed at a bottom of the receiving chamber, and a second engaging portion corresponding in position to the first engaging portion is disposed on a lateral side of the extensible rod body.

3. The suitcase of claim 1, wherein the suitcase body has a recess positioned proximate to a bottom of the suitcase body, and another end of the extensible rod body is disposed at the recess.

4. The suitcase of claim 1, wherein the extensible rod body comprises a plurality of sleeve pipes movably fitted to each other, wherein the handle is connected to the sleeve pipes above.

5. The suitcase of claim 4, wherein the extensible rod body has a lever and at least a resilient snap-engagement body, with the lever movably disposed at the sleeve pipes above, wherein the sleeve pipes each have at least a snap-engagement hole, and the lever is linked to the resilient snap-engagement body, such that the resilient snap-engagement body is movably snap-engaged with the snap-engagement holes to thereby extend and retract the extensible rod body.

6. A suitcase with a removable walking-stick extensible rod, comprising:

a suitcase body having a receiving chamber and a mouth, with the mouth disposed at a top of the suitcase body to communicate with the receiving chamber;

a fastening and releasing element fixedly disposed in the receiving chamber; and a walking-stick extensible rod having an extensible rod body and a handle, with the extensible rod body received in the receiving chamber and disposed at the fastening and releasing element, and with the handle connected to an end of the extensible rod body and disposed at the mouth, wherein the fastening and releasing element has a clamper and a fastener, the clamper comprising:

a clamper body fixed to a bottom of the receiving chamber, wherein a top plate of the clamper body has a through hole;

a withdrawal spring received in the clamper body and abutting against a bottom plate of the clamper body;

a withdrawal element fitted to the withdrawal spring to penetrate the through hole;

a right clamping element slidably disposed on the right side of the clamper body and abutting against a right sidewall of the clamper body through a right spring;

a left clamping element slidably disposed on the left side of the clamper body and abutting against a left sidewall of the clamper body through a left spring, wherein the extensible rod body is clamped between the right clamping element and the left clamping element, and the fastener is engaged with the right clamping element and the left clamping element;

a right button having a right pushing end and a right pressing end, with the right pushing end being adjacent to the left clamping element, and the right pressing end disposed on the right side of the clamper body; and a left button having a left pushing end and a left pressing end, with the left pushing end being adjacent to the right clamping element, and the left pressing end disposed on the left side of the clamper body.

7. The suitcase of claim 6, wherein the clamper further comprises:

a right rubber pad disposed on an inner side of the right clamping element; and a left rubber pad disposed on an inner side of the left clamping element, wherein the extensible rod body is clamped between the right rubber pad and the left rubber pad.

8. The suitcase of claim 6, wherein the fastener comprises:

a pivotal connection portion disposed beside the fastener and pivotally connected to one of the right clamping element and the left clamping element; and a snap-engagement portion disposed on another side of the fastener and movably snap-engaged with a bump disposed on the other one of the right clamping element and the left clamping element.

9. The suitcase of claim 8, wherein the fastener further comprises an upper rubber pad disposed at a bottom of the fastener.

* * * * *